US006352037B1

(12) United States Patent
Doyle

(10) Patent No.: US 6,352,037 B1
(45) Date of Patent: Mar. 5, 2002

(54) POSITION SENSOR HOLDER AND COVER FOR MOTOR DRIVE UNIT

(75) Inventor: James E. Doyle, Grandville, MI (US)

(73) Assignee: Suspa Incorporated, Grand Rapids, MI (US)

( * ) Notice: Subject to any disclaimer, the term of this patent is extended or adjusted under 35 U.S.C. 154(b) by 0 days.

(21) Appl. No.: 09/514,704

(22) Filed: Feb. 28, 2000

(51) Int. Cl.[7] ..... A47B 85/00
(52) U.S. Cl. ..... 108/20; 108/147; 108/50.02
(58) Field of Search ..... 108/20, 147, 50.02, 108/50.01; 312/195, 196, 223.6

(56) References Cited

U.S. PATENT DOCUMENTS 4,493,469 A * 1/1985 Holobaugh ..... 108/147 X
4,748,913 A * 6/1988 Favaretto et al. ..... 108/50.02
5,224,429 A * 7/1993 Borgman et al. ..... 108/147
5,237,935 A * 8/1993 Newhouse et al. ..... 108/50.02
5,277,131 A * 1/1994 Fortsch ..... 108/50.02
5,289,782 A * 3/1994 Rizzi et al. ..... 108/147
5,601,037 A * 2/1997 Meyer et al. ..... 108/147
5,638,759 A * 6/1997 Klugkist ..... 108/50.02
5,890,438 A * 4/1999 Frankish ..... 108/50.02 X
5,901,513 A * 5/1999 Mollenkopf et al. . 108/50.02 X
5,971,509 A * 10/1999 Deiman et al. ..... 108/50.02 X

* cited by examiner

*Primary Examiner*—Jose V. Chen
(74) *Attorney, Agent, or Firm*—Price, Heneveld, Cooper, DeWitt & Litton

(57) ABSTRACT

A position sensor holder for a powered lift system includes a polymeric member having a mounting surface on one side for attachment to the housing of a lift system and an elongated socket for receiving a magnetically responsive sensor positioned on an opposite side for providing a control signal as a magnet on a movable element of the lift system approaches the sensor. In a preferred embodiment, the socket comprises a pair of upwardly extending resilient legs for snap-receiving the sensor and including an undercut for receiving a cover element which covers the sensor and wires extending along the elongated socket coupling the sensor to a control circuit for the lift system.

30 Claims, 3 Drawing Sheets

POSITION SENSOR HOLDER AND COVER FOR MOTOR DRIVE UNIT

BACKGROUND OF THE INVENTION

The present invention relates to a motor drive unit utilizing an elongated threaded drive rod and limit sensors for controlling the position of a pusher block with respect to the drive rod and particularly to a mounting and cover assembly for the limit position sensors and drive assembly.

In work places, it is frequently desirable to provide a working surface with an adjustable height. In order to either retrofit existing work benches or tables and/or provide originally adjustable table heights, one system has employed a cylinder lift system in which fluid cylinders are attached to each of the work surface legs. A fluid pump is coupled by tubing to each of the cylinders and controlled either by a manual control or by a motor-driven assembly. Such systems are commercially available from Suspa Incorporated, the Assignee of the present invention, under the brand MOVO-TEC® lift systems. Such systems provide readily retrofit-table work surfaces which can lift loads in the range of from about 0 to about 1500 pounds depending upon the size of the system. They provide an adjustment range of from about 0 mm to about 400 mm. In place of a manually controlled pump, motor-driven units have become increasingly popular in which an electrically driven motor can be actuated to rotate a threaded rod on which a threaded pusher block is mounted. The pusher block, in turn, is coupled to the push rods of cylinders for applying pressure to fluid lines coupled to the individual leg adjusting cylinders. This system provides the advantage of easier and faster operation but requires safety features to prevent motor burnout or preventing stripping of threads of the pusher block relative to the threaded rod at the end of travels of the pusher block.

In the past, limit switches have been mounted adjacent an open slot associated with an extrusion holding the pusher block cylinders and threaded rod such that as the pusher block reaches the opposite ends of its travel limits, limit switches are actuated to disconnect power to the motor until a command is sent to the control unit for operation in an opposite direction. The motor-driven unit typically is mounted to the under surface of the table with the exposed slot allowing the mounting of limit switches in a position to be engaged by a projection on the pusher block guided within the extrusion at its travel limits. Although such systems provide the desired operational features, the threaded power screw typically is greased to provide smooth operation over a long period of time and can tend to become, depending upon the environment in which the system operates, contaminated due to the open mounting slot for the travel limit switches. Also, the open slot allows the noise from the operation of the power screw to be transmitted to the surrounding environment, making the operation of the table somewhat noisy, particularly in relatively quiet working environments.

Thus, there exists a need for a system by which a motor-driven table lift system can employ a sensor system which provides control signals for the travel limits of a pusher block associated with the drive system and reduce the noise while protecting not only the greased power screw but the sensors and control wires while positioning the sensors along the slot at desired locations.

SUMMARY OF THE INVENTION

The system of the present invention satisfies this need by providing a position sensor holder which comprises an elongated track which can be positioned over the slot in the housing of a motor-driven lift assembly and which includes sockets for receiving and holding position sensors which respond to a permanent magnet mounted to the pusher block for providing signals to a control system indicating the travel limits of the pusher block within the lift system housing.

In the preferred embodiment of the invention, the position sensor holder comprises an elongated, extruded polymeric member having a mounting surface on one side for attachment to the lift system housing and an elongated socket for receiving and holding magnetically responsive sensors, such as a reed switch or Hall-effect device, positioned on an opposite side in proximity with the slot and a magnet positioned in the pusher block such that the proximity of the magnet to the sensor actuates the sensor for providing a control signal at the travel limits of the pusher block. In a preferred embodiment also, the socket comprises an elongated, continuous track which allows adjustment of the sensor for precisely locating the sensors for desired travel limits. In a preferred embodiment also, the mounting socket comprises a pair of upwardly extending resilient legs for snap-receiving the sensors and including an undercut for receiving a cover element which covers the sensors and wires extending along the elongated socket coupling the sensors to the control system.

Thus, with the system of the present invention, a position sensor holder locates and positions travel limit sensors on the lift assembly housing, covers the power screw contained within the housing against environmental contamination, reduces noise which otherwise would escape from the open slot in the housing, holds and protects the sensors and associated wires to the housing. A snap-fit, resilient polymeric cover fits over the position sensor holder in the preferred embodiment to provide further protection for the sensor mounting system once assembled.

These and other features, objects and advantages of the present invention will become apparent to those skilled in the art upon reading the following description thereof together with reference to the accompanying drawings.

DETAILED DESCRIPTION OF THE PREFERRED EMBODIMENT

Figure 1:
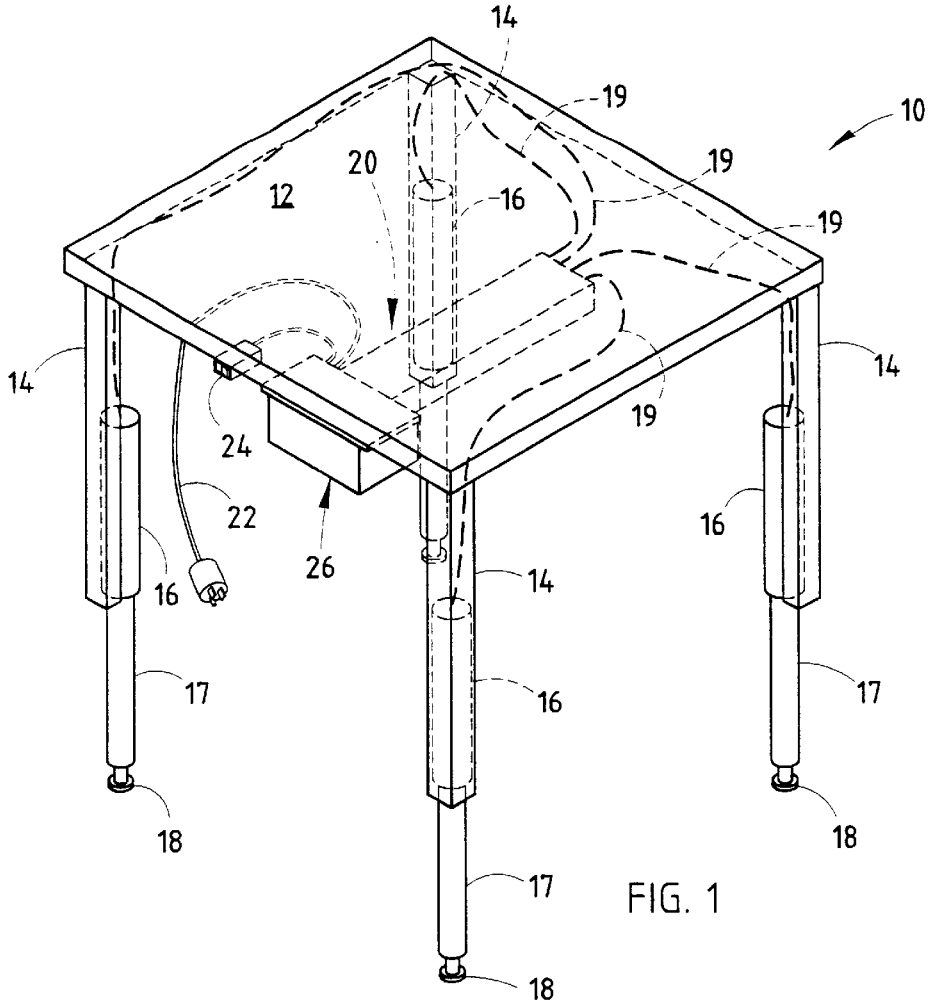
FIG. 1 is a perspective view of a work table including a motor-driven lift system embodying the present invention.

Referring initially to FIG. 1, there is shown a work table 10 embodying the present invention. Table 10 can be any type of work surface employed in a variety of environments, but one in which it is desired to raise and lower. Table 10 will typically include four downwardly depending legs 14 although, depending on the work table design, it can be a single pedestal table, a two pedestal table with inverted T-shaped legs, or the like. For the table illustrated in FIG. 1, however, there is shown four table adjusting cylinders 16, with one mounted to each of the table legs 14. The cylinders 16 are secured by conventional mounting brackets to the inside of the legs 14 so as to be less intrusive. Cylinders 16 include a telescopic extension 17 terminating in a foot pad 18, such that the effective height of the work surface 12 can be adjusted by operation of cylinders 16. Each of the cylinders is a fluid-actuated cylinder coupled by suitable pressure lines 19 to a table lift system control assembly 20.

Control assembly 20 is shown schematically in FIG. 1 and is of the type which includes an electrically operated drive motor including an electrical conductor 22 which is coupled to available AC power outlet, an up-down control switch 24 mounted to the under surface of work surface 12, and a motor housing 26. Operation of switch 24 controls an electrical motor contained within housing 26 to actuate fluid cylinders contained within the control assembly 20. They, in turn, transmit force by displacing fluid through tubes 19 and to each of the cylinders 16, thereby raising or allowing to be lowered each of the telescopic extensions 17 of the cylinder for raising and lowering the work surface 12. The motor drive assembly 20 itself and the control switch for raising and lowering the assembly can be of the construction provided by Suspa Incorporated as part number, for example, MQS-00007M sold under the brand MOVO-TEC®. The improvement to the drive assembly 20 incorporating the present invention is best illustrated in FIGS. 2–5 now described.

Figure 3:
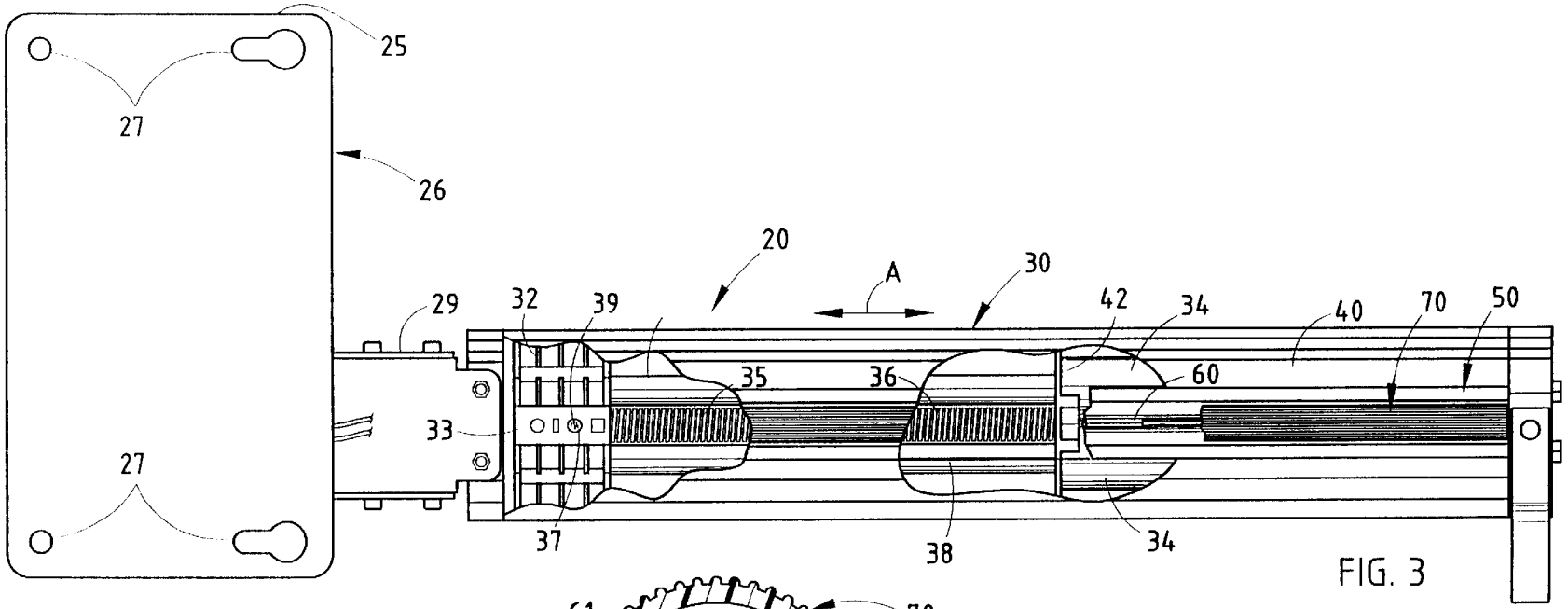
FIG. 3 is a top plan view of the motor drive unit shown in FIG. 2, shown partly broken away.

The motor drive assembly 20 includes the motor housing 26 having a top mounting plate 25 with suitable apertures 27 for mounting to the under surface of the table. Housing 26 includes an electrically actuated reversible motor, which can be an AC or DC motor, and a motor control circuit which responds to control signals from switch 24 for actuating the motor in opposite directions. Housing 26 also includes suitable drive reduction gears coupled to the motor output shaft and a coupling assembly 29 (FIG. 3) for coupling the gear output shaft to a threaded power screw 36 extending centrally within an elongated, generally rectangular, extruded housing 30. As best seen in FIG. 3, housing 30 supports the power screw 36, a slidable threaded pusher block 32, up to six fluid cylinders 34, and push rods 38 extending between cylinders 34 and pusher block 32. The end of power screw 36 remote from pusher block 32 is supported in aligned relationship by a fixed mounting block 42 which also supports cylinders 34 and their push rods 38 within the housing 30. The extruded housing includes an open slot 35 extending the length of the housing. Housing 30 is extruded of a non-ferrous metal, such as aluminum, and has an internal configuration which mateably receives the pusher block 32 which slides along the interior of the hollow extruded housing 30 in opposite directions indicated by arrow A in FIG. 3.

The pusher block 32 is also made of a non-ferrous material, preferably a lubricious polymeric material such as polycarbonate, acetal, or the like, which includes a central internally threaded aperture which is threadably secured to the power screw 36 such that rotation of the screw in opposite directions by the motor contained within housing 26 causes the pusher block to travel in an opposite directions, thereby displacing the fluid through lines 19 by the activation of cylinders 34.

Mounted within an upwardly extending projection 33 (FIG. 3) of pusher block 32 in a suitable aperture 37 is a permanent magnet 39 which, as described in greater detail below, is employed to actuate magnetically responsive sensors for controlling the travel limits of the pusher block and control the activation of the drive motor. Projection 33 extends upwardly, as best seen in FIG. 4, within the elongated rectangular slot 35 in the top surface 40 of housing 30, such that the magnet 38 is positioned substantially flush with the top surface 40 of housing 30 for actuating a magnetically responsive sensor as described below.

Figure 5:
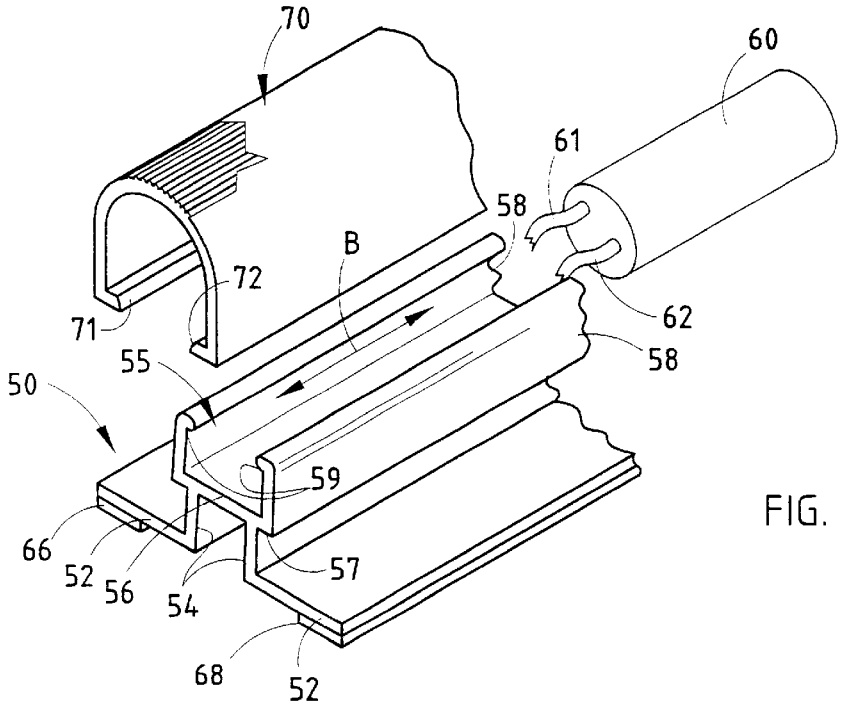
FIG. 5 is an enlarged, exploded, fragmentary view of the position sensor holder, cover and a position sensor.
Figure 2:
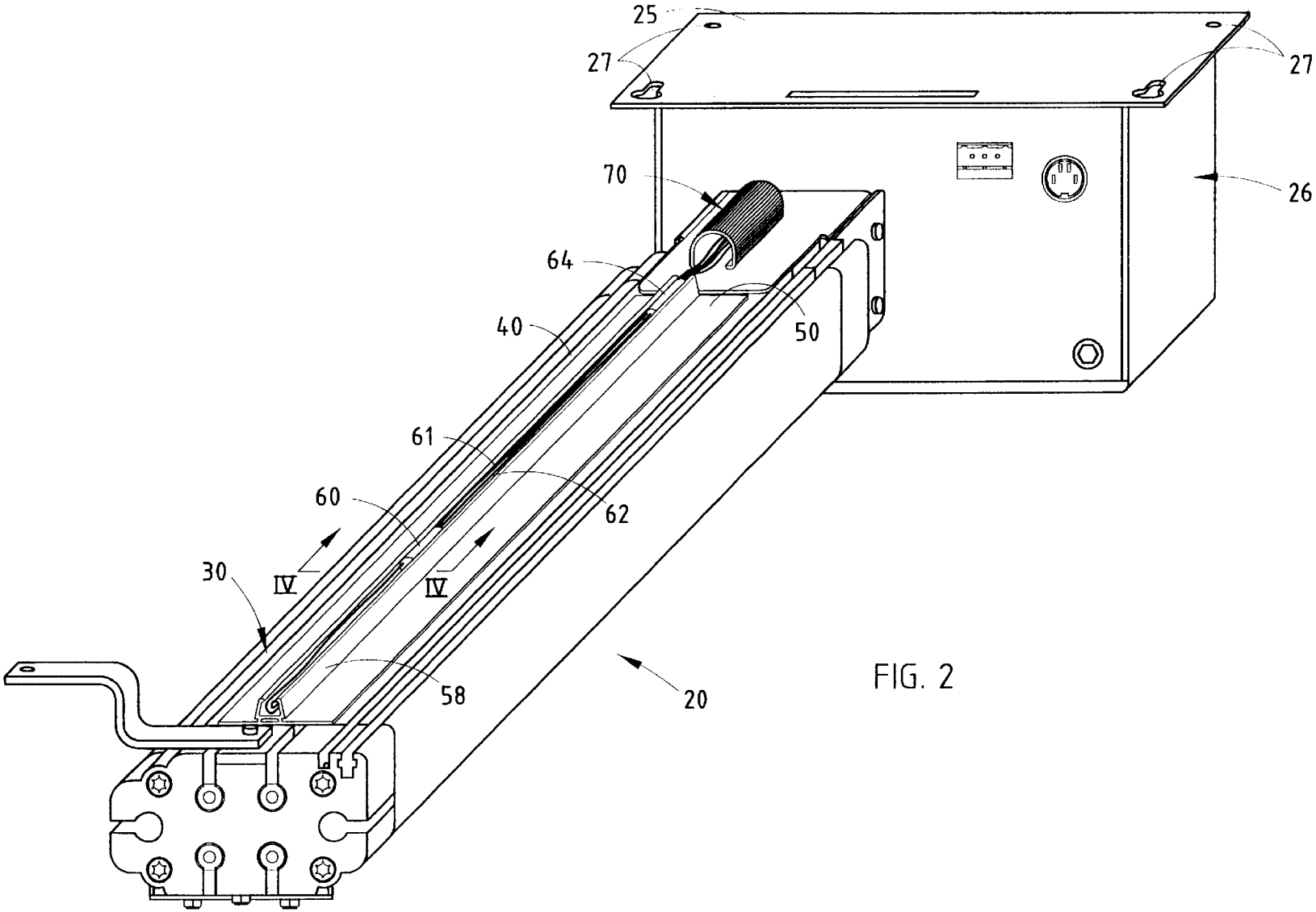
FIG. 2 is a perspective view of a motor drive unit embodying the present invention.

In FIGS. 2 and 3, the motor drive assembly 20 is shown without the pressure lines 19 coupled thereto and partially disassembled for illustrating the mounting of an elongated position sensor holder 50 onto the top surface 40 of housing 30. Position holder 50, as best seen in FIGS. 4 and 5, comprises an integrally extruded, elongated polymeric member having a pair of outwardly extending mounting flanges 52, vertically extending legs 54 supporting a generally U-shaped socket 55 defined by a floor 56 extending outwardly beyond the edges of legs 54 to define an undercut area 57 and a pair of upwardly and inwardly extending legs 58 terminating in inwardly extending facing lips 59.

Figure 4:
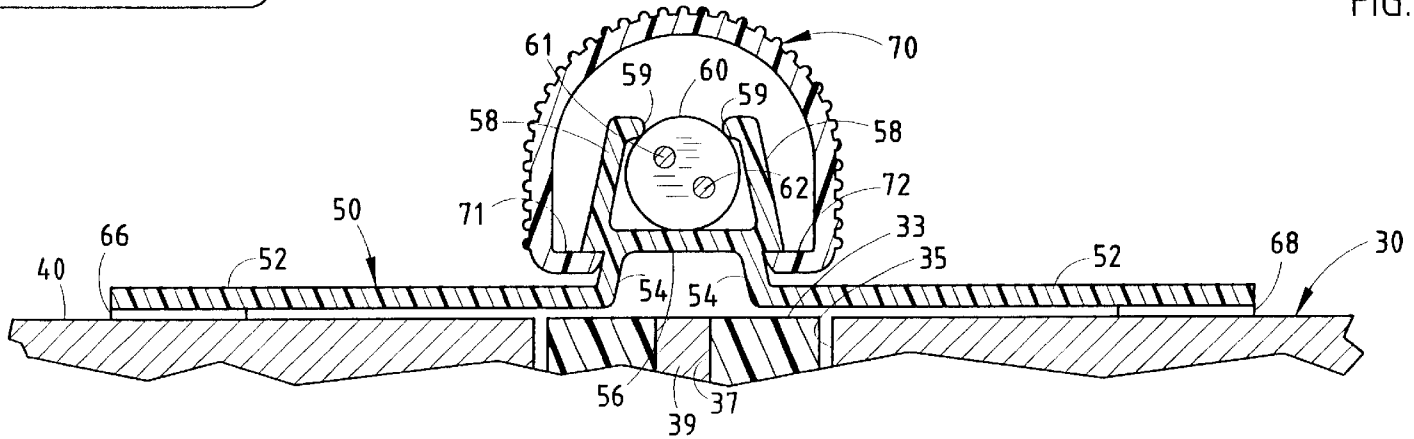
FIG. 4 is an enlarged, cross-sectional view of the position sensor holder and cover and sensor mounted to the motor drive unit shown in FIG. 2, taken along section lines IV—IV of FIG. 2.

The socket 55 so defined is shaped to snap-receive, in fixed relationship once mounted, a magnetically responsive sensor 60, which in the preferred embodiment comprises a generally cylindrical reed switch having a pair of conductors 61 and 62 for providing a closed-switch signal when magnet 38 is in proximity with the reed switch 60, as shown in FIG. 4. The elongated socket 55 comprising an elongated, generally U-shaped channel which allows a pair of sensors 60 and 64 to be located in spaced relationship along the elongated track defining socket 55 in a selectively adjustable position as indicated by arrow B in FIG. 5, such that the travel limits for the pusher block 32 can be precisely determined by the positioning of sensors 60 and 64 within the elongated socket 55. The diameter of the sensor 60 and the shape of socket 55 allow the snap-fitting and secure holding of the sensor 60 within the socket 55 by the deflection of legs 58 and the inwardly turned lips 59 which holds the sensor securely in position once fitted within the socket.

The position sensor holder 50, in a preferred embodiment, is extruded of a resilient polymeric material, such as PVC, ABS or the like, and is secured to the smooth flat upper surface 40 of the housing 30 in alignment with slot 35 thereof by means of double-backed adhesive strips 66 and 68 secured to the outer bottom edges of mounting flanges 52 such that the position sensor holder 50 can be located and positioned on the housing 30 as illustrated in FIGS. 2 and 3. The conductors 61 and 62 from sensor 60 are also conveniently located and held within the socket 55 and extra wire can be trained along the entire length of the channel defining the socket 55 as illustrated in FIG. 2. The four conductors from the two sensors 60 and 64 are trained into the control circuit contained within housing 26 in a conventional manner and, as illustrated in FIG. 2, covered by a snap-fit cover 70 as described below. The position sensor holder, therefore, provides an enclosure for the greased power screw 36 thereby protecting it from the environment since it is mounted, as best seen in FIG. 2, in spaced relationship to mounting flange 25 of housing 26, allowing a space between the under surface of table 10 and the top surface 40 of housing 30. Further, it provides a convenient adjustable mounting system for positioning magnetically responsive sensors with respect to the pusher block 32 and encloses the slot 35 of housing 30, thereby reducing the noise.

In order to provide protection for the sensors and their associated wires 61, 62, as well as to provide a trim appearance to the structure, a resilient polymeric generally U-shaped cover 70 may also be provided. Cover 70 snap-fits over the position sensor holder 50 with a pair of inwardly projecting legs 71 and 72 snap-fitting into the undercut region 57 of floor 56 of holder 50, as best seen in FIG. 4. Cover 70 thereby provides further sound dampening as well as preventing inadvertent contact with conductors associated with sensors 60, 64 during shipment of the unit and its installation and provides additional protection during the life of operation of the power lift mechanism.

With the system of the present invention, therefore, a unique position sensor holder is provided which solves several problems existent with prior art systems and is relatively inexpensive to produce. Although reed switches were employed as the sensors in the preferred embodiment of the invention, other magnetically responsive sensors, such as Hall-effect devices or the like, could likewise be mounted to a holder which includes sockets shaped to receive and hold in fixed relationship thereto such sensors. Also, the holder may not include a continuous elongated channel in some embodiments but rather could comprise shortened segments of an extrusion such as 50 shown in the figures with a continuous cover 70 providing the desired covering effect for the entire slot 35.

These and other modifications to the preferred embodiment of the invention as described herein will fall within the spirit or scope of the invention as defined by the appended claims.

The invention claimed is:

1. A position sensor and position sensor holder for use in connection with a power lift system comprising:

a magnetically responsive position sensor; and an elongated extruded polymeric member having at least one mounting flange for attachment to a power lift housing, said member integrally including an elongated socket for slidably receiving and holding said magnetically responsive position sensor therein, said socket and mounting flange aligned such that said position sensor holder can be secured to a power lift housing and said sensor moved along said socket for alignment with a magnet of a movable element of the power lift system for actuating the magnetic sensor when said position sensor holder is mounted to a power lift housing.

2. The holder as defined in claim 1 wherein said position sensor holder includes a pair of flanges extending in opposite directions and said socket is defined by upwardly extending resilient legs for snap-receiving a pair of spaced sensors therein.

3. The holder as defined in claim 2 wherein said holder is made of polymeric material.

4. The holder as defined in claim 3 wherein the upwardly extending legs include inwardly extending tips.

5. The holder as defined in claim 4 wherein the socket is defined by a floor supporting said upwardly extending legs in spaced relationship to said mounting flanges to define an undercut.

6. The holder as defined in claim 5 further including a generally U-shaped cover including inwardly projecting ends for snap-fitting over said legs of said holder.

7. The holder as defined in claim 6 wherein said cover is made of a resilient polymeric material.

8. The holder as defined in claim 7 wherein said cover and said holder are made of polyvinyl chloride.

9. The holder as defined in claim 8 wherein said position sensor is a reed switch.

10. The holder as defined in claim 1 wherein said socket extends continuously a distance such that at least a pair of spaced-apart position sensors can be selectively positioned therein.

11. A power lift system comprising:

a powered screw having a threaded pusher block, said pusher block including a control element;

a housing for said powered screw, said housing slidably receiving said pusher block, said housing including an elongated slot in predetermined longitudinal alignment with said powered screw such that said control element of said pusher block extends toward said slot; and an elongated extruded polymeric member having at least one mounting flange for attachment to said housing, said member including a socket for receiving and holding a sensor therein, said socket and mounting flange aligned such that said member can be secured to said housing such that said control element actuates said sensor when said pusher block moves into proximity to said sensor.

12. The power lift system as defined in claim 11 wherein said member includes a pair of flanges extending in opposite directions and said socket is defined by upwardly extending resilient legs for snap-receiving sensors therein.

13. The power lift system as defined in claim 12 wherein the upwardly extending legs include inwardly extending tips.

14. The power lift system as defined in claim 13 wherein the socket is defined by a floor supporting said upwardly extending legs in spaced relationship to said mounting flanges to define an undercut.

15. The power lift system as defined in claim 14 further including a generally U-shaped cover including inwardly projecting ends for snap-fitting over said legs of said member.

16. The power lift system as defined in claim 15 wherein said cover is made of a resilient polymeric material.

17. The power lift system as defined in claim 16 wherein said cover and said member are made of polyvinyl chloride.

18. The power lift system as defined in claim 11 wherein the sensor is a magnetically responsive device and said control element includes a magnet.

19. The power lift system as defined in claim 18 wherein said socket extends continuously along the length of said housing such that at least a pair of magnetic sensors can be selectively positioned therein.

20. The power lift system as defined in claim 11 and further including a fluid cylinder coupled to said pusher block, a table including at least one support leg and a cylinder with a telescopic leg coupled to said fluid cylinder for raising and lowering said table as said powered screw is moved.

21. A position sensor holder for use in connection with a power lift system comprising:

a sensor; and an elongated extruded polymeric member having at least one mounting flange for attachment to a power lift housing, said holder including an elongated socket for receiving and holding a sensor at a predetermined adjustable position therein, said socket and mounting flange aligned such that said holder can be secured adjacent the slot of a power screw mounting housing and said sensor moved along said socket to align said sensor with a control element of the power lift housing for actuating the sensor.

22. The holder as defined in claim 21 wherein the sensor is a magnetic sensor and the control element includes a magnet.

23. The holder as defined in claim 22 wherein said holder includes a pair of flanges extending in opposite directions and said socket is defined by upwardly extending resilient legs for snap-receiving the sensor.

24. The holder as defined in claim 23 wherein said holder is made of polymeric material.

25. The holder as defined in claim 24 wherein the upwardly extending legs include inwardly extending tips.

26. The holder as defined in claim 25 wherein the socket is defined by a floor supporting said upwardly extending legs in spaced relationship to said mounting flanges to define an undercut.

27. The holder as defined in claim 26 further including a generally U-shaped cover including inwardly projecting ends for snap-fitting over said legs of said holder.

28. The holder as defined in claim 27 wherein said cover is made of a resilient polymeric material.

29. The holder as defined in claim 28 wherein said cover and said holder are made of polyvinyl chloride.

30. The holder as defined in claim 21 wherein said socket extends continuously along the length of the housing such that at least a pair of sensors can be selectively positioned therein.

* * * * *